US005826624A

United States Patent [19]

Graser

[11] Patent Number: 5,826,624

[45] Date of Patent: Oct. 27, 1998

[54] PROCESS AND DEVICE FOR PARALLELING A TRANSPORT CARRIAGE

[75] Inventor: Helmut Graser, Riederich, Germany

[73] Assignee: Genkinger Hebe- und Foerderchnik GmbH, Germany

[21] Appl. No.: 522,303

[22] PCT Filed: Feb. 24, 1994

[86] PCT No.: PCT/EP94/00527

§ 371 Date: Nov. 9, 1995

§ 102(e) Date: Nov. 9, 1995

[87] PCT Pub. No.: WO94/20659

PCT Pub. Date: Sep. 15, 1994

[30] Foreign Application Priority Data

Mar. 3, 1993 [DE] Germany ..... 43 06 493.0

[51] Int. Cl.[6] ..... D03J 1/00; D02H 13/38

[52] U.S. Cl. ..... 139/1 R; 444/401; 444/911; 28/208; 242/533.8

[58] Field of Search ..... 414/401, 9, 11, 414/458; 139/1 R, 291 C, 304; 28/208; 242/533.8, 559

[56] References Cited

U.S. PATENT DOCUMENTS

| | | | |
|---|---|---|---|
| 4,843,373 | 6/1989 | Trickle et al. | 414/401 |
| 5,042,533 | 8/1991 | Kuwahara et al. | 139/1 R |
| 5,261,463 | 11/1993 | Sato | 139/1 R |

FOREIGN PATENT DOCUMENTS

| | | | |
|---|---|---|---|
| 02 96 115 | 12/1988 | European Pat. Off. . | |
| 0 360 753 | 3/1990 | European Pat. Off. | 139/1 R |
| 0 522 559 | 1/1993 | European Pat. Off. | 139/1 R |
| 85 27 488.0 | 3/1986 | Germany | 139/1 R |
| 37 17 258 | 12/1988 | Germany . | |
| 41 28 969 | 3/1993 | Germany . | |
| 17 24 753 | 4/1992 | U.S.S.R. . | |

*Primary Examiner*—Andy Falik

*Attorney, Agent, or Firm*—Flynn, Thiel, Boutell & Tanis, P.C.

[57] ABSTRACT

An apparatus and process for positioning a transport carriage that supports a cloth or yarn roller in front of a weaving machine. The apparatus is provided with two non-contact sensors that are attached to spaced apart locations on the transport carriage. The transport carriage is further provided with two selectively actuatable steerable wheels. After the transport carriage is initially positioned in front of the weaving machine distance measurements are made between the non-contact sensors and fixed reference points on the weaving machine. Based on these distance measurements the wheels integral with the transport carriage are selectively actuated in order to place the transport carriage in parallel alignment with the weaving machine.

17 Claims, 5 Drawing Sheets

PROCESS AND DEVICE FOR PARALLELING A TRANSPORT CARRIAGE

FIELD OF THE INVENTION

The invention relates to a process and a device for parallel aligning a transporting carriage for loom or cloth beams. The transporting carriage can be positioned in front of a weaving machine, and the undercarriage of the transporting carriage has two wheels which are arranged at a longitudinal distance from one another, can be steered, and, if necessary, can be driven by a motor.

BACKGROUND OF THE INVENTION

Loom beam transporting carriages of this type are mainly utilized for the loom beam exchange on weaving machines. The full loom beam must for this purpose be picked up from the ground or a storage frame, must be transported to the weaving machine, must be positioned in front of the weaving machine, and must be suspended on a loom-beam support on the machine frame. The operator usually aligns the transporting carriage by sight and through repeated transverse and longitudinal movement of the undercarriage until the carriage is parallel with the weaving machine. This operation is complicated and depending on the skill of the operator rather time-consuming. In the case of incorrect positioning, collisions occur repeatedly in the storage area of the weaving machine, in the bearing arms, and in the area of the projecting tube ends of the loom beams, thus causing unnecessary wear or damage.

Loom-beam transporting carriages of this type are mainly utilized for the cloth-beam exchange on weaving machines. A cloth-beam transporting carriage has the task to lift a full cloth beam out of a weaving machine, to cut the cloth strand, to wind the free end of the cloth strand onto an empty cloth beam, and to insert the empty cloth beam with the cloth strand to be wound thereon into the weaving machine. The loom-beam transporting carriage is for the loom-beam exchange task positioned in the cloth path in front of the respective weaving machine. The positioning in longitudinal direction can be very exact, but the parallel alignment positioning with respect to the weaving machine is difficult. If the carriage and weaving machine are not parallel, then the danger exists that an undesired crease formation occurs during winding and subsequent insertion of the new loom beam. In order to prevent this, the loom-beam transporting carriage must be aligned parallel with respect to the weaving machine.

SUMMARY OF THE INVENTION

The basic purpose of the invention is to provide a process and a device to effect a parallel alignment of the transporting carriage and the weaving machine.

This purpose is attained according to the invention by the following process steps:

The transporting carriage is positioned in the loom or cloth path relative to the weaving machine in a longitudinal direction and is aligned with at least one of its steerable wheels in a transverse travelling direction with respect to the weaving machine;

The transverse distances between two oppositely lying, machine-fixed reference surfaces are thereafter measured without contact while forming distance signals from two undercarriage-fixed positions which are arranged at a longitudinal distance from one another, and the distance signals are converted into a driving and/or steering movement of the wheels for paralleling the transporting carriage.

The two wheels are driven by a motor and are aligned in a transverse travelling direction. The wheels are oppositely driven in accordance with the distance signals or in accordance with a difference signal formed out of the distance signals until the transporting carriage is parallel aligned. With a sufficient lateral guiding of the undercarriage, it is possible to thereafter move the transporting carriage without any further measuring operation in transverse travelling direction toward the weaving machine.

As an alternative, it is possible to individually stop or to drive the two wheels, which are driven by a motor and are aligned in transverse travelling direction, in the same direction with different speeds in accordance with the distance signals or a difference signal formed out of the distance signals to parallel the transporting carriage to the weaving machine. During the transverse travel of the transporting carriage toward the weaving machine, the transverse distances between the undercarriage-fixed positions and the machine-fixed reference surfaces are thereby measured. The measured distances converted in accordance with the difference between the measured distances or their differences from the given desired reference distance into adjusting signals for operating the drive units of the transporting carriage or of the weaving machine and/or of an indicating machine. The position coordinates of the transporting carriage with respect to the weaving machine are known during its entire transverse movement because of the distance measurements. These measures assure that the conditions for an automatic loom and cloth beam exchange are met.

Energy beams, which are emitted from the undercarriage-fixed position and are reflected back on the machine-fixed reference surface, in particular ultrasound or light beams, are advantageously used for effecting distance measurement without contact.

The device for carrying out the process of the invention has two distance sensors spaced at a longitudinal distance from one another on the undercarriage, and can be aligned with reflecting surfaces of the weaving machine. An indicating and/or evaluating circuit for indicating the difference between the measured distance values and/or for controlling the driving and/or steering units of the wheels is connected to the distance sensors. The two wheels, which are driven by a motor and are aligned in transverse direction, can advantageously be driven in opposite directions through the evaluating circuit in accordance with distance signals or the difference between the signals. The distance signals are read by distance sensors. As an alternative, it is also possible to drive the wheels in the same direction in a transverse travelling direction with speeds differing in accordance with the distance signals or the difference signals.

A further advantageous development of the invention provides an undercarriage-fixed and/or machine-fixed handling mechanism controlled through the distance signals of the distance sensors for inserting or removing of the loom or cloth beam, and for controlling the driving wheels. The handling mechanism can have for this purpose an undercarriage-fixed lifting mechanism for a loom or cloth beam or a machine-fixed and/or undercarriage-fixed gripping and coupling device for gripping and releasing the loom and cloth beam.

The invention can be utilized in the same manner also for paralleling of transporting carriages in front of knitting machines, double-rib looms or cutting machines.

BRIEF DESCRIPTION OF THE DRAWINGS

The invention will be discussed in greater detail hereinafter in connection with some exemplary embodiments schematically illustrated in the drawings, in which.

DETAILED DESCRIPTION

Figure 1:
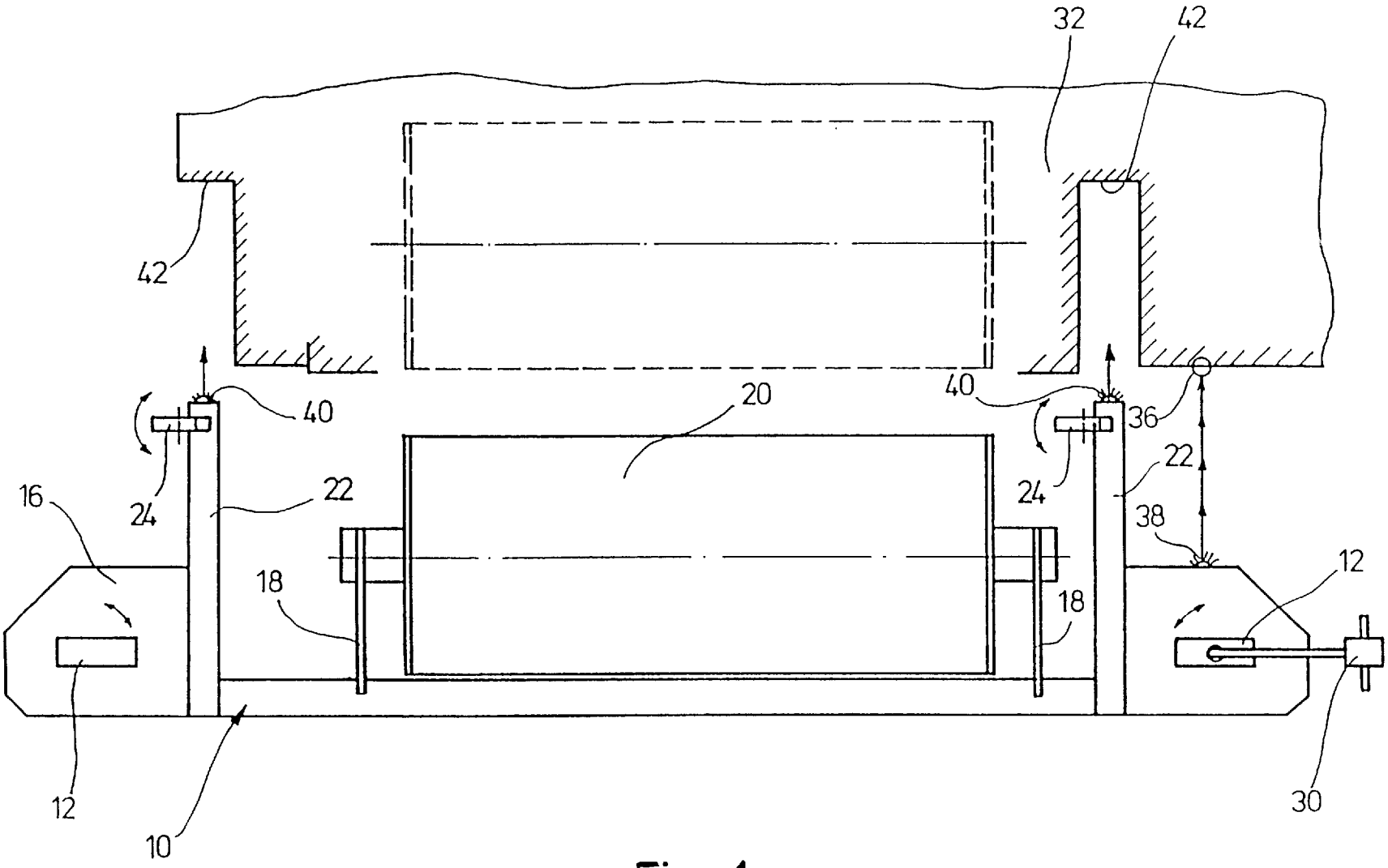
FIG. 1 is a diagrammatic view of the top of a first exemplary embodiment of a loom-beam transporting carriage in an adjusting position in front of a weaving machine.
Figure 5:
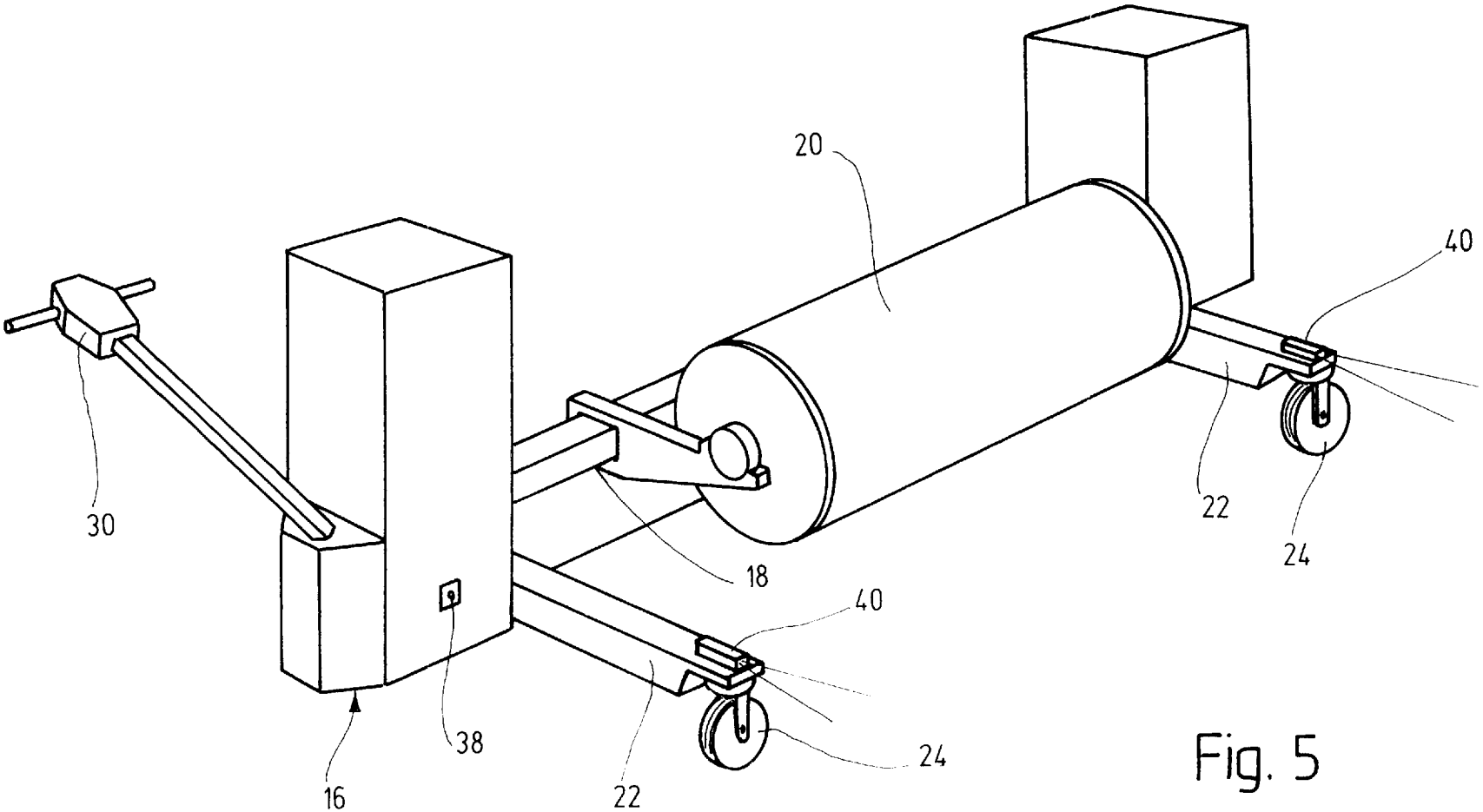
FIG. 5 is a perspective view of the loom-beam transporting carriage of FIG. 1.

The loom-beam transporting carriages 10, schematically illustrated in the drawings, have an elongated undercarriage 16 with two steerable and motor-driven wheels 12, and a lifting mechanism 18 for a loom beam 20. In addition, the exemplary embodiment illustrated in FIGS. 1 and 5 show two supporting rollers 24 which are designed as caster wheels and are pivotally arranged on cross-arms 22, whereas the exemplary embodiments according to FIGS. 2 and 3 have on the undercarriage 16 an additional wheel 26 which is aligned in longitudinal travelling direction and can be retracted when travelling in the transverse direction, and two supporting rollers 28 which can be lowered onto the ground in transverse travelling direction (only shown in FIG. 3). The wheels 12 are pivoted in longitudinal or transverse travelling direction by a control bar 30 or a steering wheel. The driving motors 48 of the driving wheels 12 are operated through operating members (not illustrated) arranged on the control bar 30.

The longitudinal positioning of the transporting carriage 10 in the loom path in front of the weaving machine 32 can be accomplished, for example, through centering a sensor 35 with a ground marking 34 (FIG. 2) or centering through a reflection light sensor 38 arranged on the transporting carriage 10 and that reacts to a target reflector 36 on the weaving machine 32 (FIG. 1).

Figure 4:
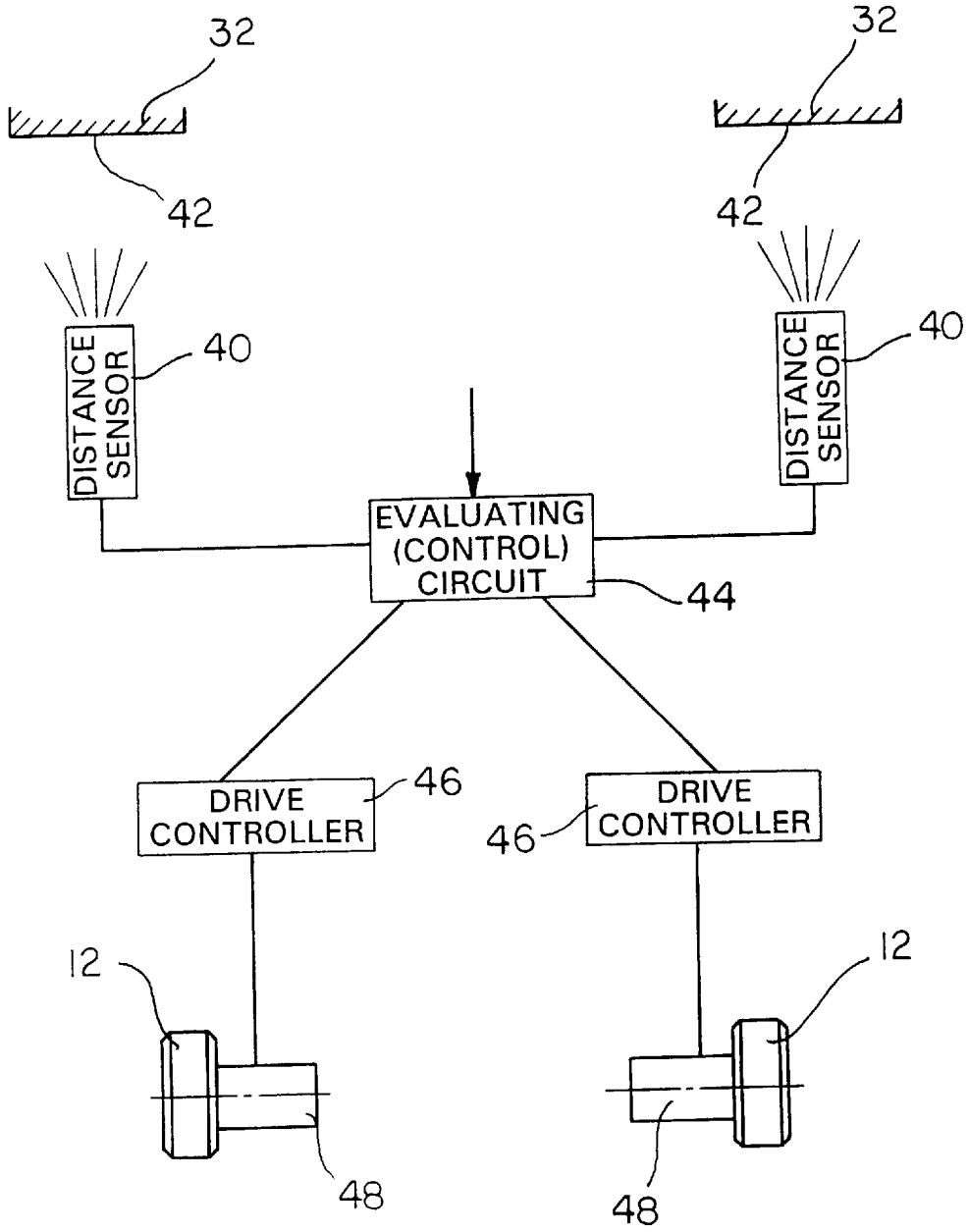
FIG. 4 is a block diagram of a device for effecting a paralleling of a transporting carriage.

The transporting carriage 10, for paralleling in front of a weaving machine, is equipped with two distance sensors 40 arranged spaced from one another and are preferably designed as an ultrasound distance-measuring device. The scanning beam of the distance sensors is each reflected back to the sensor 40 by an oppositely lying machine-fixed reference surface 42. The output signals of the distance sensors 40 are evaluated in a preferably microprocessor-supported evaluating circuit 44 for the formation of difference and path signals, and are converted into control signals for the drive controls 46 of the driving motors 48 associated with the wheels 12 (FIG. 4).

Figure 2:
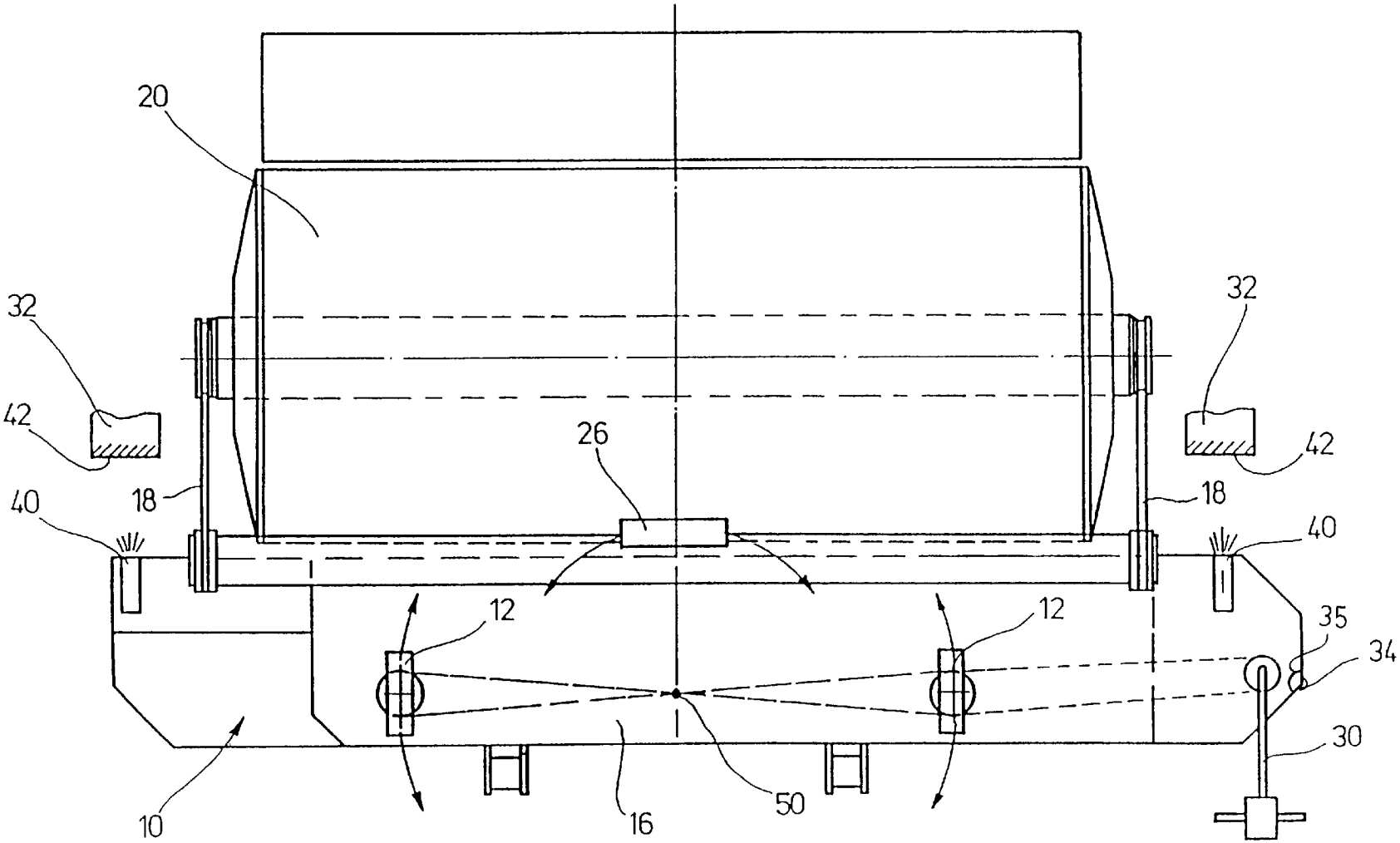
FIG. 2 is a diagrammatic view of the top of a loom-beam transporting carriage in front of a weaving machine during the parallel alignment task.

As can be seen from FIG. 2, the parallel alignment with respect to the weaving machine can be accomplished by the wheels 12 being driven in opposite directions, such that the undercarriage 16 rotates without longitudinal displacement about the pivot point 50 into the parallel position. The wheel 26 rotates in this case also about the pivot point 50. After reaching the parallel position, it is possible after lifting the wheel 26 off from the ground, and after lowering the supporting rollers 24 (not shown in FIG. 2) to drive the wheels 12 in the same direction for transverse travel toward the weaving machine.

Figure 3:
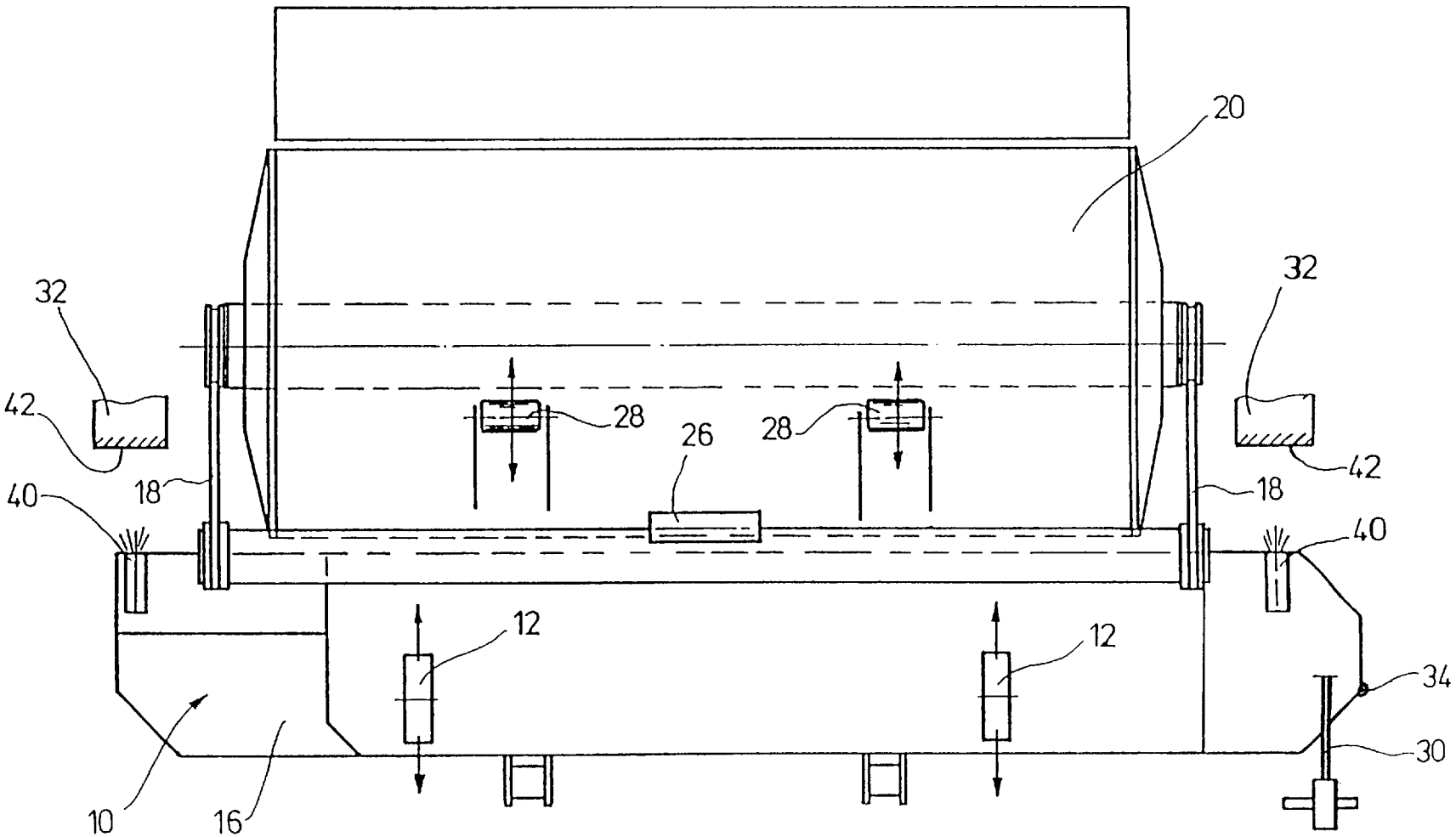
FIG. 3 is a diagrammatic view of the top of a loom-beam transporting carriage in front of a weaving machine during parallel transverse travel.

The exemplary embodiment illustrated in FIG. 3 shows that the parallel alignment can also occur during the transverse travel when the wheels 12, in accordance with the distance signals measured with the distance sensors 40, are driven in the same direction, however, at a different speed. The distance signals are evaluated in the evaluating circuit 44, and if necessary, with the support of a microprocessor. The driving energy can be controlled by the operator through an operating member (not illustrated) on the control bar 30, whereby the distance sensors 40 and the evaluating circuit 44 control the driving motors 48 to continuously position the transport carriage in parallel alignment. A position coordinate is determined during the transverse movement by the distance sensors, based on which coordinate path-dependent operations within the transporting carriage 10 or on the weaving machine 32 can also be carried out. In particular, this makes it possible to make lifting and lowering of the loom beam distance-dependent. Furthermore, a distance-dependent stopping of the transverse travelling movement or an automatic switching to slow travel is possible. Finally, it is also possible to carry out other movements, such as opening storage areas, uncoupling drives, and up to the fully automatic manipulation during the loom-beam insertion and removal tasks.

Instead of the afore-described ultrasound sensors, it is also possible to utilize infrared sensors or laser sensors for effecting the contactless distance measurement.

The embodiments of the invention in which an exclusive property or privilege is claimed are defined as follows:

1. A process for aligning a transport carriage for a cloth/yarn roller in front of a weaving machine, said process including the steps of:

providing a transport carriage having two longitudinally spaced wheels that are steerable:

positioning at least one of said steerable wheels of said transport carriage so that said at least one steerable wheel is aligned in a transverse direction to the weaving machine;

measuring the distance between said transport carriage and the weaving machine with two non-contact sensors that are attached to said transport carriage at longitudinally spaced apart locations, each said non-contact sensor measuring the distance between said non-contact sensor and a separate reference surface on the weaving machine; and selectively actuating said steerable wheels of said transport carriage based on said distance measurements made by said non-contact sensors so as to position said transport carriage in parallel alignment with the weaving machine.

2. The process for aligning a transport carriage according to claim 1, further comprising the steps of:

driving said steerable wheels of said transport carriage with a motor; and driving said steerable wheels in opposite directions based on said distance measurements in order to parallel align said transport carriage with the weaving machine.

3. The process for aligning a transport carriage according to claim 1, further comprising the steps of: driving said steerable wheels of said transport carriage with a motor; and driving said steerable wheels in the same direction at different speeds in order to parallel align said transport carriage with the weaving machine.

4. The process for aligning a transport carriage according to claim 3, further comprising driving said steerable wheels at different speeds by selectively stopping said steerable wheels independently of each other.

5. The process of aligning a transport carriage according to claim 1, further comprising the steps of: determining the difference in the distances between the weaving machine and each of said non-contact sensors on said transport carriage; and selectively actuating said steerable wheels based on said difference in the distances between the weaving machine and said non-contact sensors on said transport carriage.

6. The process of aligning a transport carriage according to claim 1, further comprising the steps of: for each said non-contact sensor on said transport carriage, determining a difference between the distance between the weaving machine and said non-contact sensor and a reference distance; and selectively actuating said steerable wheels based on said differences between the measured weaving machine non-contact sensor distances and the reference distance.

7. The process of aligning a transport carriage according to claim 1, further comprising the step of making said distance measurements by measuring the time it takes for energy emitted by said non-contract sensors to be reflected from the references surfaces on the weaving machine and, wherein said energy emitted by said non-contact sensors consists of either sonic energy or light energy.

8. The process of aligning a transport carriage according to claim 1, wherein said positioning of said transport carriage so that a first one of said steerable wheels of said transport carriage is aligned with a point on the weaving machine further comprises the step of optically aligning said transport carriage with the weaving machine so as to position said transport carriage so that one of said steerable wheels of said transport carriage is aligned with a point on the weaving machine.

9. The process of aligning a transport carriage according to claim 1, wherein said positioning of said transport carriage so that a first one of said steerable wheels of the transport carriage is aligned with a point on the weaving machine further comprises the step of aligning said transport carriage with a ground mark on a floor surface on which the weaving machine and said transport carriage are located so as to position said transport carriage so that one of said steerable wheels of said transport carriage is aligned with a point on the weaving machine.

10. A transport carriage for loading and unloading a cloth/yarn roller onto and from a weaving machine, said transport carriage including:

a carriage body having two longitudinally spaced ends;

a beam attached to said carriage body for holding the cloth/yarn roller;

two steerable wheels, said steerable wheels being located at longitudinally spaced locations on said carriage body;

drive mechanism means connected to each said steerable wheel for actuating said steerable wheels;

two non-contact distance sensor means attached to said carriage body at longitudinally spaced locations for each measuring the distance to a separate reference surface on the weaving machine and for producing distance measurement signals based on said distance measurements; and control circuit means connected to said non-contact distance sensor means so as to receive said distance measurement signals and connected to said drive mechanism means for controlling said drive mechanism means, wherein said control circuit means controls said drive mechanism means so as to selectively actuate said steerable wheels to cause said carriage body to become parallel aligned with the weaving machine based on said received distance measurement signals.

11. The transport carriage of claim 10, wherein said drive mechanism means actuates said steerable wheels in opposite directions so as to parallely align said carriage body with the weaving machine.

12. The transport carriage of claim 10, wherein said drive mechanism means actuates said steerable wheels in the same direction and at different speeds so as to parallely align said carriage body with the weaving machine.

13. The transport carriage of claim 12, wherein said control circuit means controls said drive mechanism means to cause said drive mechanism means to selectively actuate said steerable wheels independently of each other.

14. The transport carriage of claim 10, wherein said non-contact distance sensor means include means for emitting energy to said weaving machine and means for monitoring the time it takes the emitted energy to be reflected back from the reference surfaces on the weaving machine and wherein said means for emitting energy emit either sonic energy or light energy.

15. The transport carriage of claim 10, further including a positioning means attached to said carriage body for aligning one of said steerable wheels relative to a reference point on the weaving machine.

16. The transport carriage of claim 15, wherein said positioning means includes an optical position detector means for determining when said carriage body is aligned with a reference element on the weaving machine.

17. The transport carriage of claim 15, wherein said positioning means includes a sensor means for monitoring the position of said carriage body relative to a ground marking located on a floor surface over which said carriage body travels.

* * * * *

UNITED STATES PATENT AND TRADEMARK OFFICE

CERTIFICATE OF CORRECTION

PATENT NO. : 5 826 624

DATED : October 27, 1998

INVENTOR(S) : Helmut GRASER

It is certified that error appears in the above-identified patent and that said Letters Patent is hereby corrected as shown below:

On the title page, item [73]; change "Genkinger Hebe- und Foerderchnik GmbH" to ---Genkinger Hebe- und Foerdertechnik GmbH---.

Signed and Sealed this

Eighteenth Day of May, 1999

*Attest:*

Q. TODD DICKINSON

*Attesting Officer*

*Acting Commissioner of Patents and Trademarks*